United States Patent [19]

Tocco

[11] 4,429,614

[45] Feb. 7, 1984

[54] SLIP ON COMPENSATOR FOR REVOLVERS

[76] Inventor: Charles T. Tocco, 436 N. Mercy Springs Rd., #127, Los Banos, Calif. 93635

[21] Appl. No.: 234,272

[22] Filed: Feb. 13, 1981

[51] Int. Cl.[3] ..... F41C 21/18

[52] U.S. Cl. ..... 89/14 C

[58] Field of Search ..... 89/14 B, 14 C, 14 D

[56] References Cited

U.S. PATENT DOCUMENTS

| | | | |
|---|---|---|---|
| D. 185,374 | 6/1959 | Liedke et al. | 89/14 C |
| 1,054,434 | 2/1913 | Maxim | 89/14 D |
| 1,636,357 | 7/1927 | Cutts | 89/14 C |
| 2,274,239 | 2/1942 | Hughes | 89/14 C |
| 2,313,669 | 1/1943 | Reising | 89/14 C |
| 2,322,370 | 6/1943 | Lance | 89/14 C |
| 2,442,382 | 6/1948 | Sieg | 89/14 C |
| 2,953,972 | 9/1960 | Sorensen | 89/14 C |
| 3,707,899 | 1/1973 | Perrine | 89/14 C |
| 3,710,679 | 1/1973 | Werbell | 89/14 D |
| 3,808,943 | 5/1974 | Kelly | 89/14 C |

FOREIGN PATENT DOCUMENTS

| | | | |
|---|---|---|---|
| 115974 | 10/1942 | Australia | 89/14 C |

*Primary Examiner*—Stephen C. Bentley

*Attorney, Agent, or Firm*—Remy J. Van Ophem

[57] ABSTRACT

A generally cylindrical tubular member is provided with securing means for detachably securing the member to a hand gun such that the member is positioned forwardly of the end of the gun barrel and so that the cylindrical body member is aligned with the bore of the hand gun. The cylindrical body member is formed with a clamping mechanism on the opposite end which, when clamped, causes the compression of a resilient spacer member and an annular resilient insert member which are disposed around the barrel of the hand gun. The compressing forces developed by the clamping mechanism causes the resilient members to frictionally engage the barrel without damaging the barrel. The cylindrical body member also has an aperture slot formed in a selected portion of the wall forming the cylindrical body member thereby gases generated during the ignition of a related bullet assembly, may escape in a generally upward direction thereby creating generally downwardly directed reaction forces assisting in maintaining the fired fire arm stable and at least significantly eliminating the usually experienced upward jump of such fired hand guns.

9 Claims, 4 Drawing Figures

SLIP ON COMPENSATOR FOR REVOLVERS

FIELD OF THE INVENTION

The present invention relates to compensators for guns and more particularly to a device for decreasing the recoiling jump of a gun to which it is attached.

BACKGROUND OF THE INVENTION

The chief attributes of hand guns are simplicity of design, compactness and very light weight. These traits make side arms valuable hunting tools, especially in rough terrain or excessively brushy country where long guns, such as a rifle, can be difficult to carry. Hand gun hunting also represents a unique hunting challenge, a challenge which demands the utmost hunting skill and shooting ability. In spite of this, hand guns have enjoyed renewed interest by big game hunters across the United States. With the development of the 0.357 magnum, 0.41 magnum and 0.44 magnum hand guns, an experienced sportsman can kill animals as large as deer and elk at normal hunting ranges. In addition, hunters like the magnum hand guns in case of emergencies.

The magnum hand guns, however, have an undesirable heavy recoil which makes their shooting accuracy under average hunting conditions difficult. This is so because both hand guns and long guns, when fired, create a resulting reaction force driving such a firearm upwardly. As a result, hand guns have a generally downwardly depending hand grip which, when held, places the gun barrel at an elevation above the hand. Thus, when such hand guns are fired, reaction forces create a force moment couple tending to twist or rotate the gun so as to cause the muzzle to move upwardly. This form of action and reaction also applies to long guns which have a gun stock held against the person's shoulder when firing. In order to provide for aiming, etc., the long gun barrel is also at an elevation above that at when the gun stock abuts against the person's shoulder. The upward twisting motion of a firearm is also referred to as the upward kick of a gun.

The upward kick of the gun occurs very quickly such that the bullet passing through the barrel is actually still in the process of escaping the barrel muzzle when the upward kick occurs. Thus, sportsmen firing such firearms must learn to try to compensate for this error thereby imparted to the the path of the bullet, as by aiming the firearm at an elevation below the target which was intended to be struck by the bullet. In additon, since a hand gun bullet will do far less damage with marginal hits than a bullet from a medium caliber long gun, sportmen have found that pin point accuracy is required for quick, humane kills. To achieve this accuracy, a hand gun user must practice firing steadily prior to going to the field. In addition, he must perfect his hunting skills so that he can get as close as possible to the game. Prior to firing his handgun, the sportsman must assume a rock solid rest position whenever possible. This is because the human body is a semi-soft mound of quivering muscles, pulsating arteries and jumpy nerves. Therefore, holding a lightweight firearm at arm's length is not conducive to decent accuracy. Furthermore, since magnum hand guns have heavy recoils, a sportsman must "roll with the punch" by holding his gun so that he recoils straight back onto the line of his waist. It has been found that if one shifts the grip on the hand gun in order to fight the recoil, the bullets will be thrown to the left or right of the point of aim. Thus, magnum hand guns are difficult to fire rapidly and accurately.

Various known prior art devices have been devised in an attempt to overcome such upward kicks. One such prior art attempt was to actually machine holes in the gun barrel so as to have holes at the opposite sides of the centerline of the gun barrel and a generally upper portion thereof. This is a very expensive process of gun alteration and, though not, fully understood why, such attempts have not proven to be satisfactory because such altered gun barrels still exhibit a high degree of upward kick. Examples of such gun barrel modifications are shown in U.S. Pat. No. 2,916,970 to Mutter and U.S. Pat. No. 3,808,943 to Kelley. The Mutter device, utilizing a series of small rearwardly inclined drilled holes, produced a "blow back" of high discharge gases toward the operator of the firearm and a nozzling of gases resulting in increased noise. Kelly, on the other hand, provides venting directly to the atmosphere which causes an unbalance in the gas column which, in turn, created a decelerating effect on the projectile.

Other prior art devices teach the use of an adapter or an attachment to the muzzle of a firearm. For example, Cutts in U.S. Pat. No. 1,636,357 issued July 19, 1927, discloses a substantially cylindrical member threaded internally to engage one end of a muzzle of a rifle barrel. Reising in U.S. Pat. No. 2,313,669 issued Mar. 9, 1943, describes another such compensator for automatic firearms. Sieg, in U.S. Pat. No. 2,442,382 issued June 1, 1948, describes a compensator for rifles. Sieg teaches a compensator having a cylindrical body with the annular wall provided with a series of slots which are bevelled to assist in directing the gas forwardly. Finally, Lance in U.S. Pat. No. 2,322,370 issued June 22, 1943, discloses a compensator for firearms having an externally tapered form and an internal cylindrical bore uniform diameter. The wall of the compensator has a series of apertures spaced uniformly along the vertical plane with the apertures being forwardly inclined away from the muzzle at a uniform angle.

All of the aforementioned compensators are complex and difficult to manufacture and none of the known prior art designs work effectively with powerful, highly loaded big caliber magnum bullets which produce heavy recoils in a magnum hand gun. In addition, all of the aforementioned compensators cause the accuracy of the gun to suffer either because of poor manufacturing tolerances or due to the buidup of lead and unburned powder residue in the unit.

SUMMARY OF THE INVENTION

The present invention is directed to a compensator device which detachably secures to the gun barrel to minimize the full upward kick of a fired hand gun.

The present invention provides a compensator device for use on an associated gun. The gun has a gun body and a gun barrel. The gun barrel has a portion defining a bore formed therein. The compensator device includes a cylindrical body member having one end, an opposite end and portions defining a first internal diameter extending from the one end towards the opposite end and a second internal diameter larger than the first internal diameter and extending from the opposite end toward the one end. The cylindrical body member further has a radial shoulder portion formed at the intersection of the first and second internal diameters. The first internal diameter is slightly larger than the diameter of the bore in the gun barrel. The second internal diameter is slightly greater than the outer diameter of the gun barrel. A securing mechanism, mounted adjacent to the opposite end of the cylindrical body member, detachably secures the cylindrical body member to the gun barrel so as to position the first internal diameter of the cylindrical body member in substantial axial alignment with the bore of the gun barrel. Finally, a venting aperture mechanism formed through the wall of the cylindrical body member is interposed the one end and the radial shoulder portion. The venting aperture mechanism includes an elongated slot having a longitudinal axis substantially perpendicular to the longitudinal axis of the cylindrical body member, the elongated slot further being upwardly disposed. The longitudinal axis of the elongated slot is generally contained within a vertical plane passing through the axis of the bore of the gun barrel when the gun is held in a generally horizontal firing position. Thus, when the gun is fired, the gases generated during the ignition of a related bullet assembly freely escape the one end of the gun barrel unrestricted by the structural relationship established between the gun barrel and the one end of the cylindrical body member toward the elongated slot. The gases pass therethrough in a generally upward direction, thereby creating a generally downwardly directed reaction force assisting in maintaining the fired gun stable to at least significantly minimize the full upward kick of the fired gun.

It is therefore a primary object of the present invention to provide a compensator device, which detachably secures to the gun barrel by means of a clamping device with a resilient compressible member between the gun barrel and the cylindrical body member so as to prevent marring the gun barrel, whereby gases generated during the ignition of a related bullet assembly may escape in a generally upward direction thereby creating generally downwardly directed reaction forces assisting in maintaining the firearm stable so as to at least significantly minimize the otherwise full upward kick of the fired gun.

It is still yet a further object of the present invention to provide a compensator device which detachably secures to the gun barrel of the gun being fired which is simple to make and inexpensive to produce and minimizes the otherwise full upward kick of the fired gun.

It is still yet a further object of the present invention to provide a compensator device which detachably secures to the gun barrel by means of a clamping mechanism compressing a resilient member interposed the clamping member and the gun barrel so as to prevent marring of the gun barrel. In addition, the device has an elongated slot having a longitudinal axis substantially perpendicular to the longitudinal axis of the cylindrical body member such that when the gun is fired in a generally horizontal firing position, the gases generated during the ignition of the related bullet assembly freely escape the one end of the gun barrel unrestricted by the structural relationship established between the gun barrel and the one end of the cylindrical body member toward the elongated slot. Thus, the gases pass through the elongated slot in a generally upward direction to create a generally downwardly directed reaction force which assists in maintaining the fired gun stable so as to at least signficantly minimize the full upward kick of the fired gun.

These and other objects and advantages of the invention will become apparent with reference to the following detailed description of the preferred embodiment when considered in conjunction with the accompanying drawings.

BRIEF DESCRIPTION OF THE DRAWINGS

In the drawings, wherein for purposes of clarity certain details may be omitted from one or more views.

DETAILED DESCRIPTION OF THE PREFERRED EMBODIMENT

Figure 1:
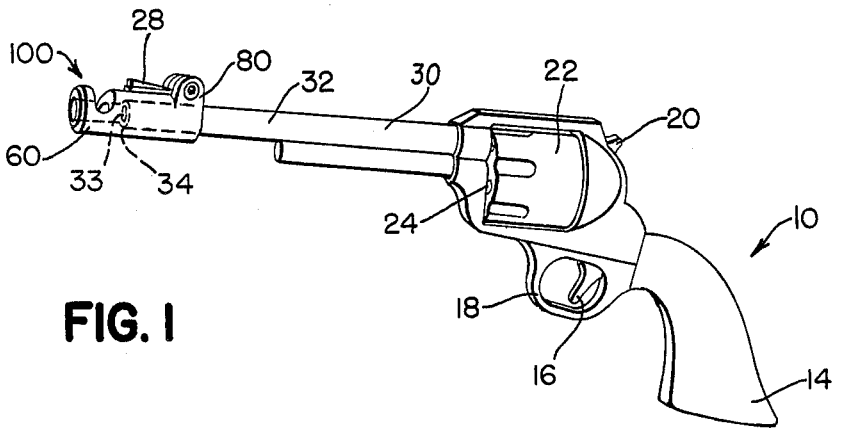
FIG. 1 is a perspective view of the compensator according to the present invention attached to a gun barrel.

Referring in greater detail to the drawings, FIG. 1 shows the compensator device according to the present invention which is generally designated by the numeral 100 as being operatively assembled and secured to a hand gun 10. The hand gun 10 includes, for example, a hand grip portion 14, a trigger 16, a trigger guard 18, a hammer 20, a bullet cylinder 22 having apertures 24 to receive bullets (not illustrated) therein. The hand gun 10 also has a gun sight 28 mounted on the outer diameter surface 30 of the gun barrel 32 adjacent the one end 34. The gun barrel 32 has a bore 33 formed therethrough of substantially the same diametral dimension as the bullets used by the handgun 10. The general structure and operation of hand guns is well known in the art. Those skilled in the art will recognize that the hand gun 10, by way of nonlimiting example, may be a 0.44 Magnum handgun manufactured by Sterm, Ruger and Company Inc. of Southport, Connecticut under the Trademark "Ruger Super Black Hawk".

Figure 2:
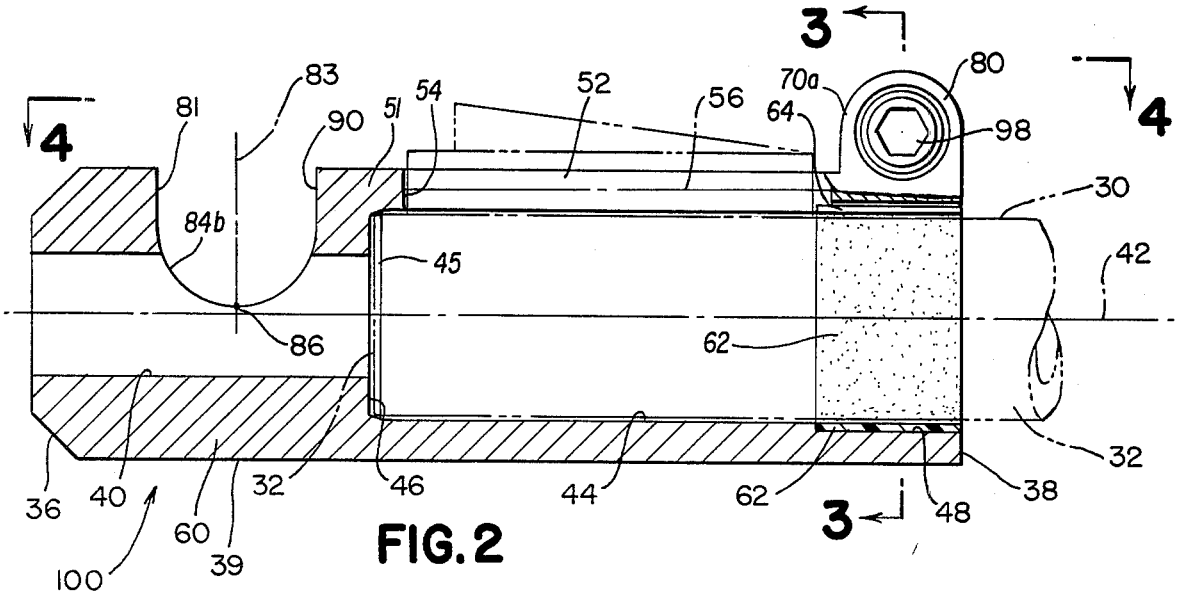
FIG. 2 is a vertical sectional view of the compensator of FIG. 1.
Figure 3:
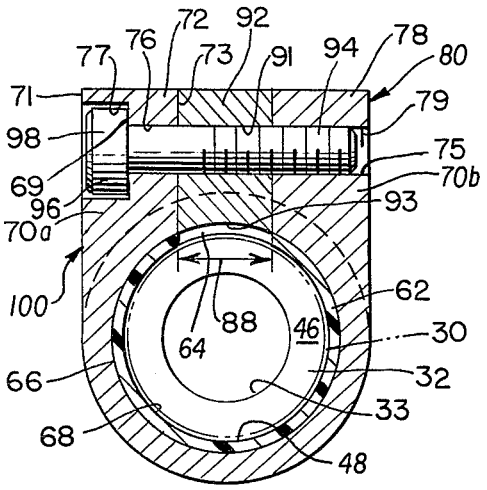
FIG. 3 is a sectional view taken along line 3—3 of FIG. 2 showing the attaching mechanism to the gun barrel.
Figure 4:
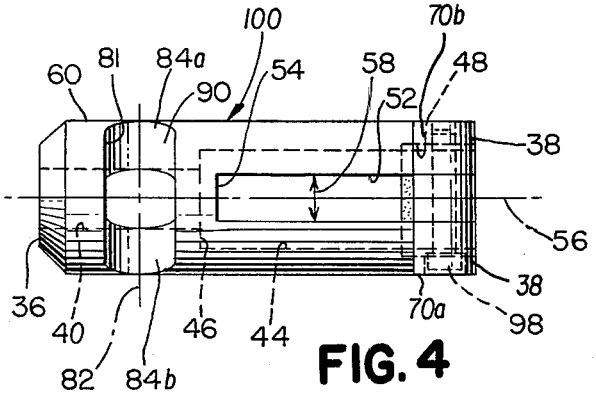
FIG. 4 is a sectional veiw taken along line 4—4 of FIG. 2.

As shown in FIGS. 2 through 4, the compensator device 100 includes a cylindrical body member 60, securing means 80 and venting aperture means 90.

The cylindrical body member 60 has a one end 36 and an opposite end 38. A first internal passage 40 extends from the one end 36 towards the opposite end 38 of the cylindrical body member 60. The first internal passage 40 has an internal diameter of substantially constant diametral dimension which is greater than the bore 33 formed in the gun barrel 32. Preferably, by way of non-limiting example, the first internal passage 40 is 0.485 inches in diameter. A second internal passage 44 extends from the opposite end 38 towards the one end 36 along the same longitudinal axis 42. The second internal passage 44 includes a bore of substantially constant diametral dimension which is greater than the outer diameter of the gun barrel 32. A radial shoulder portion 46 is interposed the first and second internal passages 40 and 44 at a predetermined distance from the one end 36 for a purpose to be described later herein. A frusto-conical radially inwardly tapering surface 45 (FIG. 2) is formed between the radial shoulder portion 46 and the second internal passage 44. The tapering surface 45 engages the mating tapered surface (not illustrated but well known in the art) on the gun barrel adjacent its one end 34. Thus, when the gun barrel 32 is inserted into the second internal passage 44, the one end 34 of the gun barrel 32 engages the radial shoulder portion 46 and the mating tapering surface (not illustrated) engages the inwardly tapering surface 45 to form a gas seal to prevent the backflow of gases when a bullet is fired from the hand gun 10. A counterbore 48 is formed on the opposite end 38 and extends towards the one end 36 for a predetermined distance from the opposite end 38 for a purpose to be described later herein. Thus, the cylindrical body member 60 has a longitudinal axis 42 (FIG. 2) along which the first internal passage 40 communicates with a second internal passage 44 which in turn communicates with the counterbore 48. The radial shoulder portion 46 is further formed perpendicular to the longitudinal axis 42. The cylindrical body member 60 is preferably made of steel. The cylindrical body member is also preferably, by way of non-limiting example, made with a wall thickness of 0.25 inches adjacent the one end 36 of the first internal passage 40.

The cylindrical body member 60 further has slot aperture means 50 formed in the wall 51 (FIG. 2) of the cylindrical body member. The slot aperture means 50 includes an elongated slot 52 which extends from the opposite end 38 towards the one end 36. The elongated slot 52 further extends a predetermined distance from the opposite end 38 such that the one end 54 of the elongated slot 52 terminates before the radial shoulder portion 46. The elongated slot further forms a longitudinal axis 56 (FIG. 4) which is parallel to the longitudinal axis 42 (FIG. 2) of the cylindrical body member 60. The elongated slot further has a predetermined width 58 (FIG. 4) so as to permit inserting the gun sight 28 within the slot aperture means 50.

An annular resilient insert member 62 is disposed in the counterbore 48 of the cylindrical body member 60. The annular resilient insert member 62 is formed with a slot 64 which extends along a line parallel to the longitudinal axis of the annular resilient insert member 62. The annular resilient insert member 62 has an outer diameter 66 which is substantially the same as the counterbore 48. Additionally, the inner diameter 68 of the annular resilient insert member 62 is substantially the same diametral dimension as the outer diameter 30 of the gun barrel 32.

The securing means 80 includes clamping means 78. As best shown in FIG. 3, the clamping means 78 includes a pair of bosses **70*a* and 70*b* which extend vertically and substantially parallel from the outer diameter of the wall 51 of the cylindrical body member 60. Thus, one boss 70*a* is formed at the opposite end 38 of the cylindrical body member 60 so as to be on one side of the elongated slot 52 while the other boss 70*b* extends from the opposite end 38 of the cylindrical body member 60 so as to be spaced parallel thereto and to be spaced a distance or gap 88 from the one boss 70*a* in a substantially similar manner. The one boss 70*a* has a first aperture 76 having an axis formed above the outer diameter 39 of the cylindrical body member 60. In addition, the first aperture 76 is formed substantially perpendicular to the longitudinal axis 56 of the elongated slot 52. The one boss 70*a* further has a counterbore 77 which extends from the one end 71 thereof toward the opposite end 73 thereof. The other boss 70*b* has a second aperture 75 which is axially aligned with respect to the first aperture 76. The second aperture 75 also has an internal screw thread 79. In the preferred embodiment, the distance or gap 88 is substantially the same dimensional length as the predetermined width 58 of the slot 52**.

A screw threaded fastener member 98, having a socket head 96 at one end and a mating external screw thread 94 provided on a post extending from the socket head 96, is inserted into the counterbore 77 and the first aperture 76 of the one boss **70*a* so as to extend therethrough. In addition, the screw threaded fastener member 98 threadably engages the internal screw thread 79 in the other boss 70*b*. A resilient spacer member 92 having an aperture 91 with a diametral dimension slightly greater than the first aperture 76 is inserted in the gap 88 formed between the one boss 70*a* and the other boss 70*b*. Additionally, the resilient spacer member 92 has an inner arcuate surface 93 which conforms to the outer diameter 30 of the gun barrel 32. Thus, when the gun barrel 32 is inserted into the second passage 44 of the cylindrical body member 60, the gun sight 28 extends through the elongated slot 52. To secure the cylindrical body member 60 to the gun barrel 32, the screw threaded fastener member 98 is inserted into the counterbore 77 and first aperture 76 of the one boss 70*a*. Thus, the socket head 96 abuts against a shoulder 69 formed between the counterbore 77 and the first aperture 76. The screw threaded fastener member 98 also extends through the first aperture 76 across the gap 88, through the aperture 91 in the resilient spacer member 92 so that the mating screw thread 94 engages the screw thread 79 in the other boss 70*b*. Thus, when the socket head is rotated, the mating screw threads 94 engage the internal screw threads 79 thereby causing the other boss 70*b* to move toward the one boss 70*a*. In doing so, the resilient spacer member 92 and the annular resilient insert member 62 are compressed with the result that a large frictional force is exerted at the interface of the outer diameter 30 of the gun barrel 32, that is, between the inner arcuate surface 93 of the resilient spacer member 92 and the outer diameter 30 and the inner diameter 68 of the annular resilient insert member 62. In the preferred embodiment, the resilient spacer member 92 is made of acrylic plastic well known in the prior art whereas the annular resilient insert member 62 is made of nylon plastic, also well known in the prior art. The resilient spacer member 92 and the annular resilient insert member 62 are made of resilient material, preferably plastics identified heretofore in order to prevent damaging, i.e. by marring or scratching the outer diameter 30 of the gun barrel 32 and yet provide a compressible member to frictionally engage the outer diameter 30**.

Those skilled in the art will recognize that the securing means 80, heretofore described, provides an easily detachable and easily securable mechanism to attach the compensator device 100 to a hand gun 10. In addition, the securing means 80 prevents damage to the gun barrel 32 of the hand gun 10 even after repeated attachment and detachment of the compensator device 100 thereto.

The venting aperture means 90 illustrated in FIGS. 2 and 4, includes an elongated slot 81 which is upwardly disposed in the cylindrical body member 60 so as to be between the one end 36 and the radial shoulder portion 46. In addition, the elongated slot 81 further has a first transverse axis 82 (FIG. 4) generally contained within a vertical plane 83 (FIG. 2) which passes generally perpendicular to the longitudinal axis 42 of the cylindrical body member 60 and the longitudinal axis 56 of the elongated slot 52. In addition, the elongated slot 81 has a pair of downwardly extending arcuate portion **84*a* and 84*b* (FIG. 4) formed therein such that one of the pairs of portions 84*a* is disposed on one side of the longitudinal axis 42 of the cylindrical body member 60 and the other of the pair of portions 84*b* is disposed on the other side of the longitudinal axis 42. Thus, each of the pair of arcuate portions 84*a* and 84*b* has a nadir 86 (FIG. 2). A second transverse axis is formed passing through each nadir 86 which is substantially perpentothe longitudinal axis 42 of the cylindrical body member 60 and is formed, by way of non-limiting example, 0.20 inches above the longitudinal axis 42. Those skilled in the art will recognize that the elongated slot 81 is by non-limiting example formed by a 0.5 inch mill cutter and therefore provides a substantially larger flow area than the cross sectional area of the bore 33 of the gun barrel 32. This enhances the free escape of the gases generated during the ignition of a bullet from the bore 33 of the gun barrel 32 so that the gases may pass unrestricted through the compensator device 100** to at least significantly minimize the full upward kick of a fired gun.

It has been found that the use of the compensator device 100 on a hand gun 10 provides an excellent means of effectively producing a pneumatic type brake which resists the otherwise twisting motion or upward kick that is usually experienced upon firing of an associated gun. That is, the gases produced upon ignition of the propellant of the bullet assembly escape, at least to a great part, through the upwardly directed aperture or venting aperture means 90 formed in and through the upper portion of the cylindrical body member 60. In being thusly directed upwardly, an equal and opposite pneumatic reaction force is developed downwardly to thereby push the one end 34 of the gun barrel 32 of the hand gun 10 downwardly in such a manner that it overcomes the force moment couple previously described and created by the firing of a hand gun tending to cause the gun to have the upward kick. Furthermore, since the compensator device 100 has the venting aperture means 90 disposed forwardly of the one end 34 of the gun barrel 32, the downward reaction forces have an increased effective lever arm, which by multiplication, increases the effective reaction force moment couple.

As is apparent to those skilled in the art, the invention may be practiced in various configurations. That is, the compensator device 100 may be made of a single unitary piece machined, or otherwise formed, as to have the desired configuration previously described or, in the alternative, the compensator device 100 may be formed of, for example, multiple pieces secured to each other to form the configuration previously described.

Futhermore, even though various changes may be made to the preferred embodiment of the invention to produce perfectly acceptable results, the first internal passage 40 may be enlarged near the venting aperture means 90 to be approximately equal to the bore 33 of the gun barrel 32.

In addition, it has been determined that apparently optimum results are obtained if the longitudinal length of the cylindrical body member 60 from the radial shoulder portion 46 to the one end 36, that is, that portion of the cylindrical body member 60 disposed forwardly of the one end 34 of the gun barrel 32, is by way of non-limiting example 1.53 inches and that the first transverse axis 82 of the venting aperture means is formed by way of non-limiting example 0.656 inches from the one end 36 of the cylindrical body member 60.

Those skilled in the art will appreciate that while the preferred embodiment has been described in conjunction with a 0.44 Magnum hand gun, the principles and teachings of the present invention may be applied to different caliber hand guns as well as many other types and configurations of hand guns, revolvers, long guns and pistols which are currently available in the market place.

Although only the preferred embodiment of the present invention has been disclosed and described, it is apparent that other embodiments and modifications of the invention are possible within the scope of the appended claims.

What is claimed is:

1. A compensator device for controlling the recoil of an associated gun having a gun body means and a gun barrel, said gun barrel having an outer diameter, a gun sight on said outer diameter adjacent the one end and a bore formed therein, said compensator device comprising:

a cylindrical body member having one end and an opposite end, said cylindrical body member further having an outer diameter, a first internal passage extending from said one end towards said opposite end, a second internal passage larger than said first internal passage extending from said opposite end toward said one end, a counter-bore adjacent said opposite end, said counterbore being larger than said second internal passage and further being centrally located therewith and a radial shoulder portion interposed said one end and said opposite end and formed between said first and second internal passages, said first internal passage having an internal diameter of substantially constant diametral dimension and being greater than the said bore formed in the gun barrel, said second internal passage having an internal bore of substantially constant diametral dimension and being greater than the outer diameter of said gun barrel, said second internal passage further being concentric with said first internal passage;

an annular resilient insert member mounted on said outer diameter of said gun barrel and in said counterbore of said cylindrical body member;

securing means, mounted adjacent to said opposite end of said cylindrical body member, for detachably securing said cylindrical body member to said gun barrel so as to place said internal diameter of said first internal passage of said cylindrical body member in substantial axial alignment with said bore of said gun barrel, said securing means further comprising clamping means, formed in said opposite end of said cylindrical body member, for clamping said cylindrical body member to said gun barrel such that said second internal passage of said cylindrical body member is in frictional engagement with outer diameter of gun barrel, said clamping means further comprising:

a. a pair of bosses extending from said outer diameter of said cylindrical body member adjacent to said opposite end, said pair of bosses further being substantially parallel and spaced apart from each other, one of said bosses having a portion defining a first aperture, said first aperture having an axis which is substantially perpendicular to the longitudinal axis of said second internal passage, the other of said bosses having a portion defining a second aperture centrally aligned with respect to said first aperture, said second aperture having screw thread means formed therein; and b. a screw thread fastener member inserted through said first aperture and threadably engaging said screw thread means in said second aperture, said screw thread fastener member having a head larger than said first aperture, said head abutting against the one of said bosses so that when said screw thread fastener member is rotated to further engage said screw thread means in said second aperture, said screw thread fastener member draws the one of said bosses towards the other of said bosses to compress said annular resilient insert member and clamp said outer diameter of said gun barrel; and venting aperture means formed through the wall of said cylindrical body member interposed said one end and radial shoulder portion, said venting aperture means including a portion generally contained within a vertical plane passing through the axis of said bore of said gun barrel when said gun is held in a generally horizontal firing position, such that when said gun is fired, the gases generated during the ignition of a related bullet assembly freely escape said one end of said gun barrel, unrestricted by said structural relationship established between the gun barrel and said one end of said cylindrical body member toward said venting aperture means and pass therethrough, thereby creating reaction forces assisting in maintaining the fired gun stable.

2. The compensator device of claim 1 wherein said venting aperture means further comprises an elongated slot at a transverse axis substantially perpendicular to the longitudinal axis of said cylindrical body member, said elongated slot further being upwardly disposed, said transverse axis of said elongated slot being generally contained within a vertical plane passing through the axis of said bore of said gun barrel when said gun is held in a generally horizontal firing position such that when said gun is fired, the gases generated during the ignition of a related bullet assembly freely escape said one end of said gun barrel, unrestricted by the structural relationship established by the gun barrel and said one end of said cylindrical body towards said elongated slot and passed therethrough in a generally upward direction thereby creating generally downwardly directed reaction forces assisting and maintaining the fired gun stable so as to at least significantly minimize the upward kick of the fired gun.

3. A compensator device as claimed in claim 2 further comprising:

slot aperture means formed through the wall of said cylindrical body member from said opposite end to adjacent said radial shoulder portion, said slot aperture means including an elongated slot having one end and a longitudinal axis extending through said elongated slot from said one end to said opposite end of said cylindrical body member substantially parallel to said longitudinal axis of said cylindrical body, said elongated slot receiving gun sight of gun barrel therein.

4. A compensator device for use on an associated gun having gun body means and a gun barrel, said gun barrel having a portion defining a bore formed therein, said compensator device comprising:

a cylindrical body member having one end, an opposite end and portions defining an outer diameter, a first internal diameter extending from said one end toward said opposite end and a second internal diameter larger than said first internal diameter and extending from said opposite end toward said one end, a counterbore at said opposite end, said counterbore being larger than said second internal diameter and further being centrally located therewith, said cylindrical body member further having a radial shoulder portion formed at the intersection of said first and second internal diameter, said first internal diameter being slightly greater than said bore in said gun barrel, said second internal diameter being slightly greater than the diameter of the gun barrel;

an annular resilient insert member mounted on said outer diameter of said gun barrel and in said counterbore of said cylindrical body member;

securing means, mounted adjacent to said opposite end of said cylindrical body member, for detachably securing said cylindrical body member to said gun barrel so as to position said first internal diameter of said cylindrical body member in substantial axial alignment with said bore of said gun barrel, said securing means further comprising means, formed in said opposite end, for clamping said cylindrical body member to said gun barrel such that said internal passage of said cylindrical body member is in frictional engagement with said outer diameter of said gun barrel wherein said clamping means further comprises:

a. a pair of bosses extending from said outer diameter of said cylindrical body member adjacent to said opposite end, said pair of bosses further being substantially parallel and spaced apart from each other, one of said bosses having a portion defining a first aperture, said first aperture having an axis which is substantially perpendicular to the longitudinal axis of said second internal passage, the other of said bosses having a portion defining a second aperture centrally aligned with respect to said first aperture, said second aperture having screw thread means formed therein; and b. a screw thread fastener member inserted through said first aperture and threadably engaging said screw thread means in said second aperture, said screw thread fastener member having a head larger than said first aperture, said head abutting against the one of said bosses so that when said screw thread fastener member is rotated to further engage said screw thread means in said second aperture, said screw thread fastener member draws the one of said bosses toward the other of said bosses to compress said annular resilient insert member and clamp said outer diameter of said gun barrel; and venting aperture means formed through the wall of said cylindrical body member interposed said one end and said radial shoulder portion, said venting aperture means including a portion generally contained within a vertical plane passing through the axis of said bore of said gun barrel when said gun is held in a generally horizontal firing position, such that when said gun is fired, the gases generated during the ignition of a related bullet assembly freely escape said one end of said gun barrel unrestricted by the structural relationship established between said gun barrel and said one end of said cylindrical body member toward said venting aperture and pass therethrough thereby creating reaction forces assisting in maintaining the fired gun stable.

5. A compensator device as claimed in claim 4 wherein said radial shoulder portion is formed a predetermined distance from said one end.

6. A compensator device as claimed in claim 4 wherein the end of said gun barrel abuts against said radial shoulder portion when said securing means detachably secures said cylindrical body member to said gun barrel.

7. A compensator device as claimed in claim 4 further comprising:

a resilient spacer member interposed the one end of the other of said pair of bosses.

8. The compensator device of claim 4 wherein said venting aperture means further comprises an elongated slot at a transverse axis substantially perpendicular to the longitudinal axis of said cylindrical body member, said elongated slot further being upwardly disposed, said transverse axis of said elongated slot being generally contained within a vertical plane passing through the axis of said bore of said gun barrel when said gun is held in a generally horizontal firing position such that when said gun is fired, the gases generated during the ignition of a related bullet assembly freely escape said one end of said gun barrel, unrestricted by the structural relationship established by the gun barrel and said one end of said cylindrical body towards said elongated slot and passed therethrough in a generally upward direction thereby creating generally downwardly directed reaction forces assisting and maintaining the fired gun stable so as to at least significantly minimize the upward kick of the fired gun.

9. A compensator device as claimed in claim 8 wherein said elongated slot further comprises a pair of arcuate portions formed on each side of said longitudinal axis of said cylindrical body member, the nadir of each of said pair of arcuate portions forming an axis which intersects and is substantially perpendicular to said longitudinal axis of said cylindrical body member.

* * * * *